US011376181B2

(12) United States Patent
Gresham

(10) Patent No.: US 11,376,181 B2
(45) Date of Patent: Jul. 5, 2022

(54) BODY CONTAINMENT GARMENT

(71) Applicant: Ronald E. Gresham, Moorhead, MN (US)

(72) Inventor: Ronald E. Gresham, Moorhead, MN (US)

( * ) Notice: Subject to any disclaimer, the term of this patent is extended or adjusted under 35 U.S.C. 154(b) by 450 days.

(21) Appl. No.: 16/674,266

(22) Filed: Nov. 5, 2019

(65) Prior Publication Data

US 2021/0128386 A1 May 6, 2021

(51) Int. Cl.
*A61G 17/06* (2006.01)

(52) U.S. Cl.
CPC ..... *A61G 17/06* (2013.01)

(58) Field of Classification Search
CPC .. A61G 17/06; A61G 17/007; A61G 17/0136; A61G 5/449; A61F 5/449
USPC ..... 27/28; 2/64
See application file for complete search history.

(56) References Cited

U.S. PATENT DOCUMENTS 1,612,279 A * 12/1926 Friedline ..... A41D 1/00 2/105
1,626,450 A * 4/1927 Cannon ..... A41D 1/00 2/235
7,703,186 B1 * 4/2010 Williamson ..... A61G 17/007 27/35
2004/0031133 A1 * 2/2004 Pace ..... A61G 17/048 27/19
2010/0138972 A1 * 6/2010 Novak ..... A61G 17/0136 2/243.1

FOREIGN PATENT DOCUMENTS

CN 215075626 U * 12/2021

* cited by examiner

*Primary Examiner* — William L Miller
(74) *Attorney, Agent, or Firm* — Neustel Law Offices

(57) ABSTRACT

A body containment garment for containing body fluids from deceased individuals, particularly following tissue or organ donation procurement. The body containment garment generally includes a unitary structure including a pair of arm portions, a pair of leg portions, and a body portion. The only openings in the containment garment are a pair of arm openings at the distal end of the arm portions and a neck opening at the upper end of the body portion through which the head of the deceased may extend. The containment garment may be heat-shrunk to tightly and snugly fit around the body of the deceased. In this manner, the deceased may wear burial clothing without any noticeable bulky undergarment and prevent leakage of bodily fluids and the like.

20 Claims, 10 Drawing Sheets

BODY CONTAINMENT GARMENT

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a body containment garment for containing body fluids from deceased individuals, particularly following tissue or organ donation procurement.

Related Art

Any discussion of the related art throughout the specification should in no way be considered as an admission that such related art is widely known or forms part of common general knowledge in the field.

For centuries, survivors of lost loved ones have often held ceremonies to commemorate, remember, and say goodbye to the deceased. In many cultures, it is common for there to be a "viewing" of the deceased during which family members, friends, and the like may visit and view the deceased individual one final time prior to being internment or cremation. It is also increasingly common for the deceased to be viewed at or before a funeral service, such as with an open casket.

In some cases, such as when an autopsy has been performed or when tissues or organs have been donated by the deceased, there can be significant discharge of fluids and the like from the deceased. This can be particularly problematic in cases in which the deceased is to be viewed prior to internment or cremation. In such cases, plastic garments have been used to prevent leakage of body fluids and the like. However, such plastic garments are often lightweight and can easily tear. Further, such plastic garments often do not fit the deceased, and are thus crinkly and bulky underneath clothing.

SUMMARY

An example embodiment is directed to a body containment garment. The body containment garment includes a unitary structure including a pair of arm portions, a pair of leg portions, and a body portion. The only openings in the containment garment are a pair of arm openings at the distal end of the arm portions and a neck opening at the upper end of the body portion through which the head of the deceased may extend. The containment garment may be heat-shrunk to tightly and snugly fit around the body of the deceased. In this manner, the deceased may wear burial clothing without any noticeable bulky undergarment and prevent leakage of bodily fluids and the like.

There has thus been outlined, rather broadly, some of the embodiments of the body containment garment in order that the detailed description thereof may be better understood, and in order that the present contribution to the art may be better appreciated. There are additional embodiments of the body containment garment that will be described hereinafter and that will form the subject matter of the claims appended hereto. In this respect, before explaining at least one embodiment of the body containment garment in detail, it is to be understood that the body containment garment is not limited in its application to the details of construction or to the arrangements of the components set forth in the following description or illustrated in the drawings. The body containment garment is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
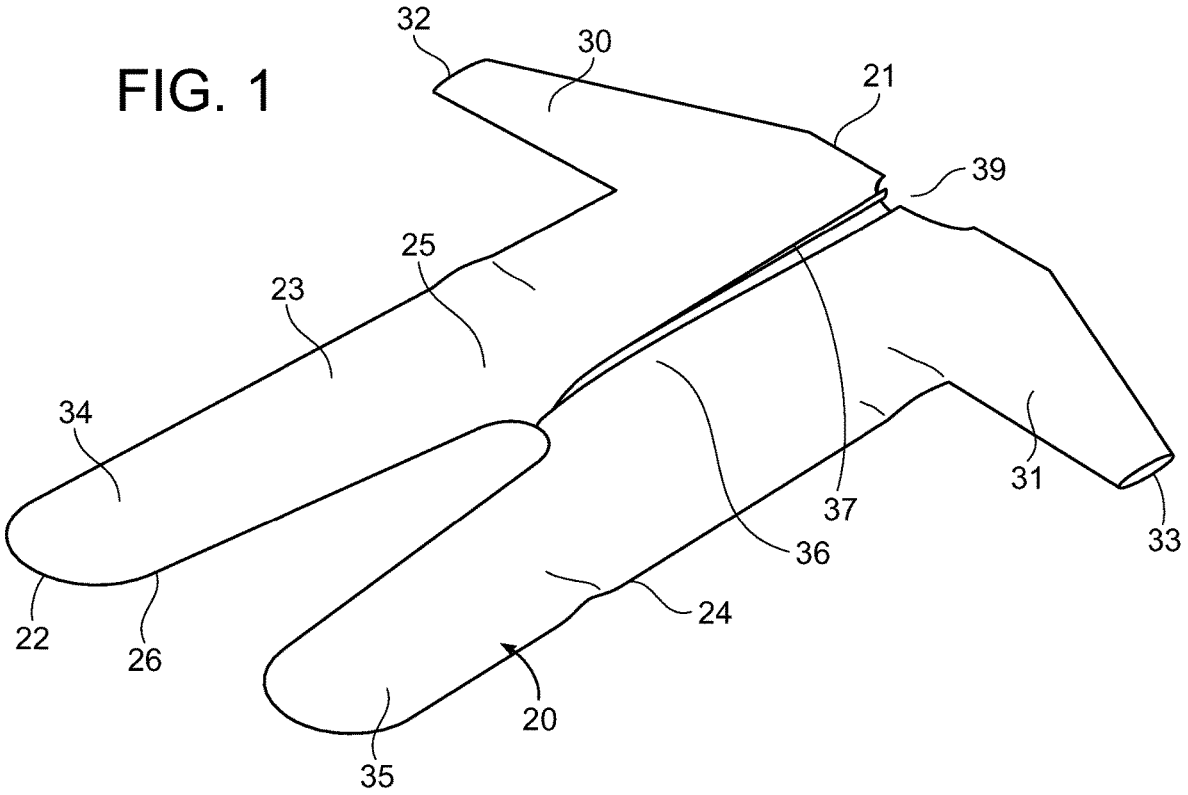
FIG. 1 is an upper perspective view of a body containment garment in accordance with an example embodiment.

A. Overview.

An example body containment garment 10 generally comprises a body portion 36 comprised of an upper end 21, a lower end 22, a first side 23, a second side 24, a front end 25, and a rear end 26, wherein the body portion 36 is adapted to fit around a body 12 of a deceased individual. A neck opening 39 is positioned at or near the upper end 21 of the body portion 20 through which a head of the body 12 of the deceased individual may extend.

A first arm portion 30 extends outwardly from the body portion 36 in a first direction, wherein the first arm portion 31 is adapted to receive a first arm of the deceased individual. A second arm portion 32 extends outwardly from the body portion 36 in a second direction, wherein the second arm portion 32 is adapted to receive a second arm of the deceased individual. A first leg portion 34 extends outwardly from the body portion 36, wherein the first leg portion 34 is adapted to receive a first leg of the deceased individual. A second leg portion 35 extends outwardly from the body portion 36, wherein the second leg portion 35 is adapted to receive a second leg of the deceased individual. A central slit 37 extends between the upper end 21 and the lower end 22 of the body portion 20.

The body portion 36, the first arm portion 30, the second arm portion 31, the first leg portion 34, and the second leg portion 35 each comprise a heat-shrinkable material such that the body portion 36, the first arm portion 30, the second arm portion 31, the first leg portion 34, and the second leg portion 35 shrink to tightly fit around the body 12 of the deceased individual upon application of heat from a heat source 40. The first arm portion 30 may comprise a first arm opening 32 and the second arm portion 31 may comprise a second arm opening 33. The neck opening 39 may be adjustable in size, such as by cutting with scissors.

The containment garment 20 may include a closure device for closing the central slit 37 around the body of the deceased individual, such as heat-shrinkable tape 38. The body portion 36, the first arm portion 30, the second arm portion 31, the first leg portion 34, and the second leg portion 35 may be comprised of a single, unitary structure. The body portion 36, the first arm portion 30, the second arm portion 31, the first leg portion 34, and the second leg portion 35 may be comprised of a plastic material, such as polypropylene sheeting or polyethylene sheeting. The heat source 40 may be comprised of a handheld air blower for blowing heated air.

A method of using the body containment garment 20 may comprise the steps of positioning the body containment garment 20 on a flat surface; positioning the body 12 of the deceased individual on the body containment garment 20; positioning the first arm of the deceased individual in the first arm portion 30 of the body containment garment 20; positioning the second arm of the deceased individual in the second arm portion 31 of the body containment garment 30; positioning the first leg of the deceased individual in the first leg portion 34 of the body containment garment 20; positioning the second leg of the deceased individual in the second leg portion 35 of the body containment garment 20; and closing the central slit 37 so as to enclose the body 12 of the deceased individual within the body containment garment 20.

The method of using the body containment garment 20 may also comprise the step of applying a closure device 38 to close the central slit 37 of the body containment garment 20 and applying heat to the closure device 38 to close the body portion 36 of the containment garment 20 in a sealed manner. Heat may also be applied to the containment garment 20 such that the containment garment 20 shrinks around the body 12 of the deceased.

B. Containment Garment.

As shown throughout the figures, a containment garment 20 may be utilized to snugly and tightly fit around the body 12 of the deceased so as to prevent leakage of bodily fluids and the like. The shape, size, and configuration of the containment garment 20 may vary in different embodiments. For example, while the containment garment 20 is eventually shrunk to fit the body 12 as described below, the containment garment 20 may still be available in a number of standardized sizes given the significant range of weights and heights possible for the deceased.

In the exemplary figures, an exemplary containment garment 20 is illustrated comprising an upper end 21, a lower end 22, a first side 23, a second side 24, a front end 25, and a rear end 26. The containment garment 20 is generally configured to fit over a human body and may thus include a first arm portion 30, a second arm portion 31, a first leg portion 34, and a second leg portion 35.

Figure 2:
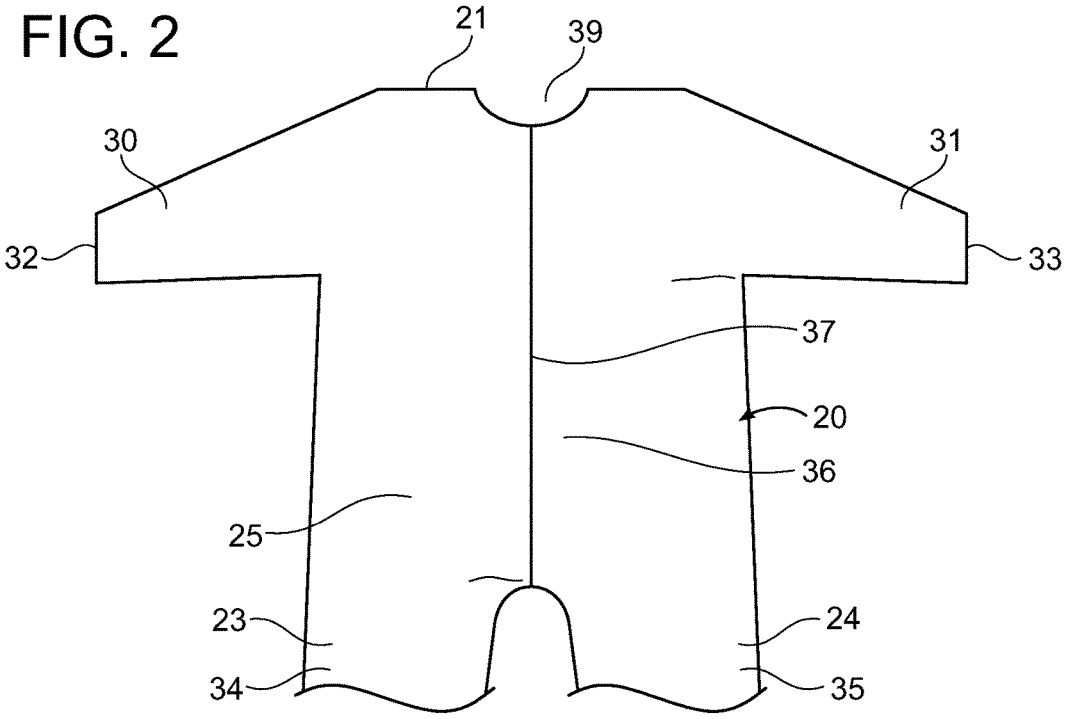
FIG. 2 is a partial top view of a body containment garment in accordance with an example embodiment.
Figure 3:
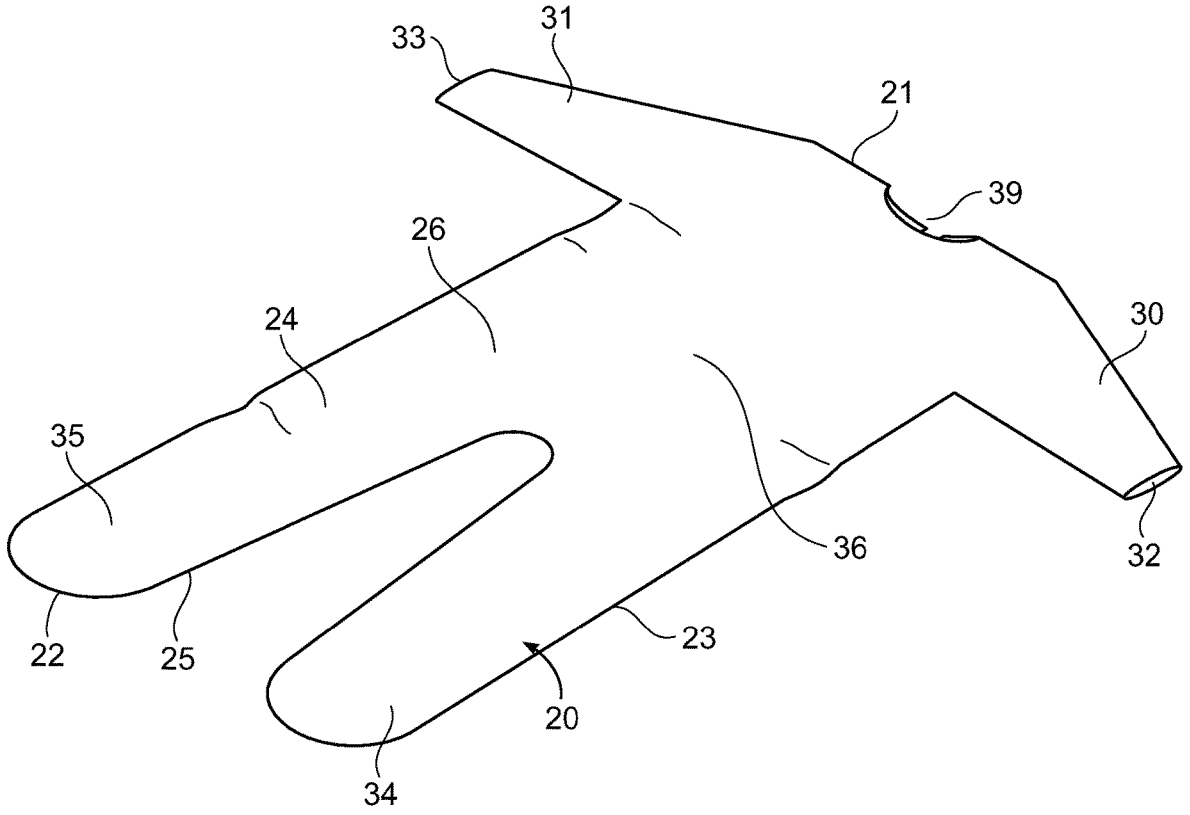
FIG. 3 is a lower perspective view of a body containment garment in accordance with an example embodiment.
Figure 4:
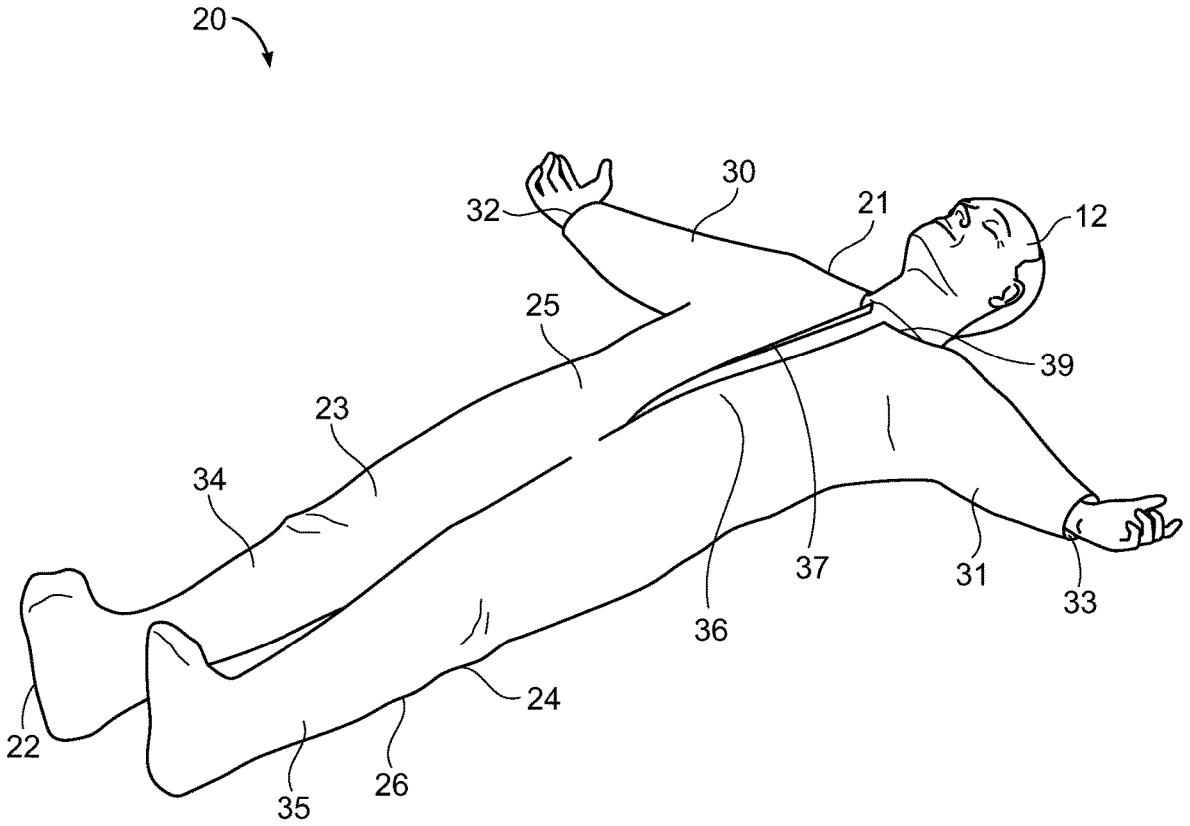
FIG. 4 is an upper perspective view of a loosely worn body containment garment in accordance with an example embodiment.

As best shown in FIGS. 1-3, the first arm portion 30 extends outwardly from the first side 23 of the containment garment 20 near the upper end 21 of the containment garment 20. The first arm portion 30 is adapted to receive a first arm of the deceased such as shown in FIG. 4. The first arm portion 30 may include a first arm opening 32 at the distal end of the first arm portion 30 through which the hand of the deceased may extend. In this manner, the hand of the deceased may be visible even when waring the containment garment 20 and burial clothing 13, which allows the deceased to wear any rings or watches they may have treasured during life.

Similarly, as best shown in FIGS. 1-3, the second arm portion 31 extends outwardly from the second side 23 of the containment garment 20 near the upper end 21 of the containment garment 20. The second arm portion 31 generally extends in an opposite direction with respect to the first arm portion 30. The second arm portion 31 is adapted to receive a second arm of the deceased such as shown in FIG. 4. The second arm portion 31 may include a second arm opening 33 at its distal end through which the other hand of the deceased may extend.

Using the pair of arm portions 30, 31 each having a respective arm opening 32, 33 permits the hands of the deceased to be visible even when wearing the containment garment 20 and burial clothing 13. This permits the deceased to wear any rings or watches they may have treasured during life. However, it should be appreciated that, in some embodiments, the arm portions 30, 31 may be closed-off and thus not have respective openings 32, 33 through which the hands may extend. The arm portions 30, 31 will generally be larger (wider) than the legs of the deceased such that the leg portions 30, 31 may be heat-shrunk to snugly fit the legs of the deceased as discussed below.

It should also be appreciated that the angle at which the arm portions 30, 31 extend outwardly from the body portion 36 of the containment garment 20 may vary. While the arm portions 30, 31 are flexible, they will generally have a resting position when no force is applied and the containment garment 20 is not being worn. The angles between the respective arm portions 30, 31 and body portion 36 may vary when in this state, and should not be construed as limited by the exemplary embodiments shown in the figures. It should also be appreciated that the length of the arm portions 30, 31 may vary in different embodiments.

As best shown in FIGS. 1-3, the containment garment 20 may include a pair of leg portions 34, 35. A first leg portion 34 will generally extend outwardly from the body portion 36 of the containment garment 20 and a second leg portion 35 will generally extend outwardly from the body portion 36 of the containment garment 20. The first leg portion 34 will generally be on the first side 23 of the containment garment 20 and the second leg portion 35 will generally be on the second side 24 of the containment garment 20. The length of the leg portions 34, 35 may vary in different embodiments.

Each of the leg portions 34, 35 is adapted to fit over each leg of the deceased, with the first leg being positioned in the first leg portion 34 and the second leg being positioned in the second leg portion 35 such as shown in FIG. 4. The leg portions 34, 35 will generally be larger (wider) than the legs of the deceased such that the leg portions 34, 35 may be heat-shrunk to snugly fit the legs of the deceased as discussed below.

As shown in the figures, neither of the leg portions 34, 35 include any type of opening or the like. This prevents leakage of bodily fluids and the like. Thus, the leg portions 34, 35 are generally enclosed at their distal ends, with the feet of the deceased being completed covered. Typically, the feet of the deceased are not visible during a viewing, as they are often covered by a sheet or the enclosed portion of the coffin lid. However, in some embodiments, the leg portions 34, 35 may include openings through which the feet of the deceased may extend. In such cases, it may be desirable to tape or otherwise secure the leg portions 34, 35 around the ankles of the deceased to prevent leakage.

As best shown in FIGS. 1 and 2, the containment garment 20 may include a central slit 37 extending vertically along the body portion 36 between the upper end 21 and lower end 22 of the containment garment 20. The central slit 37 divides the body portion 36 of the containment garment 20 into two. The central slit 37 is shown as extending across the front end 25 of the containment garment 20. However, in some embodiments, the central slit 37 may instead be positioned on the rear end 26 of the containment garment 20.

The length of the central slit 37 may vary in different embodiments and should not be construed as limited by the exemplary figures. The central slit 37 may be shorter than shown in the figures, such as by not extending fully to the crotch area of the containment garment 20 but instead terminated at a point above the crotch area on the body portion 36 of the containment garment 20. In other embodiments, multiple slits 37 may be utilized if desired.

The central slit 37 is used to easily fit the deceased body 12 within the containment garment 20 prior to closure such as shown in FIG. 4. The body portion 36 may be opened up by spreading the first and second sides 23, 24 of the containment garment 20 outwardly. The deceased may then be placed in the body portion 36 of the containment garment 20 with the legs in the leg portions 34, 35 and the arms in the arm portions 30, 31.

The body portion 36 may then be closed around the body 12 and the central slit 37 may be closed. The central slit 37 may be secured in a number of manners. Preferably, the manner of closing the central slit 37 will prevent leakage by sealing the containment garment 20 around the body 12. In an exemplary embodiment shown in FIG. 5, a closure device such as tape 38 has been used to close the central slit 37. In other embodiments, closures such as adhesives, clamps, magnets, fasteners, and the like may be utilized. In a preferred embodiment, heat-shrinkable tape 38 may be utilized to seal the central slit 37.

As shown in FIGS. 4-7, the containment garment 20 may include a neck opening 39 through which the head of the deceased may extend and be visible when the containment garment 20 is worn. The shape and size of the neck opening 39 may vary in different embodiments. The neck opening 39 is generally comprised of a semi-circular or arc-shaped opening such as shown in FIG. 2. If needed, the size of the neck opening 39 may be adjusted, such as by using scissors or another cutting device to easily cut the neck opening 39 to a larger size, such as to accommodate a larger head of the deceased.

The containment garment 20 is generally comprised of a unitary structure, though in some embodiments the containment garment 20 may comprise two or more interconnected pieces that are secured together. It is preferred to utilize a unitary structure, however, to prevent leakage. The containment garment 20 may be larger in size than the deceased body 12, but may be shrunk to fit and seal the body by application of heat as discussed below, alone or in combination with tucking, taping, and folding any loose portions of the containment garment 20.

The containment garment 20 may comprise a wide range of materials, but will preferably be comprised of a flexible material known to shrink upon application of heat. In some embodiments, the containment garment 20 may comprise plastic materials, such as polypropylene or polyethylene. An exemplary sized containment garment 20 may comprise 6.5 feet long by 5.5 feet wide so as to fit an adult. However, different sizes may be utilized to fit different adults or, in some cases, to fit children.

By way of example and without limitation, the containment garment 20 may comprise polypropylene sheeting which is known to shrink upon application of heat. The thickness of the containment garment 20 may vary but, in a preferred embodiment, may comprise 6 millimeters of polypropylene sheeting so as to prevent inadvertent tearing or the like. The color of the containment garment 20 may vary and, by way of example, may comprise white or clear sheeting.

The manner in which the containment garment 20 is formed may also vary in different embodiments. In the embodiment shown in the figures, two sheets of polypropylene sheeting material have been heat welded together in an anthropoid shape. In other embodiments, the polypropylene sheeting material may be formed of a unitary structure initially, thus negating the requirement for a pair (or more) of sheets of material to be heat welded together prior to use or distribution.

Figure 6:
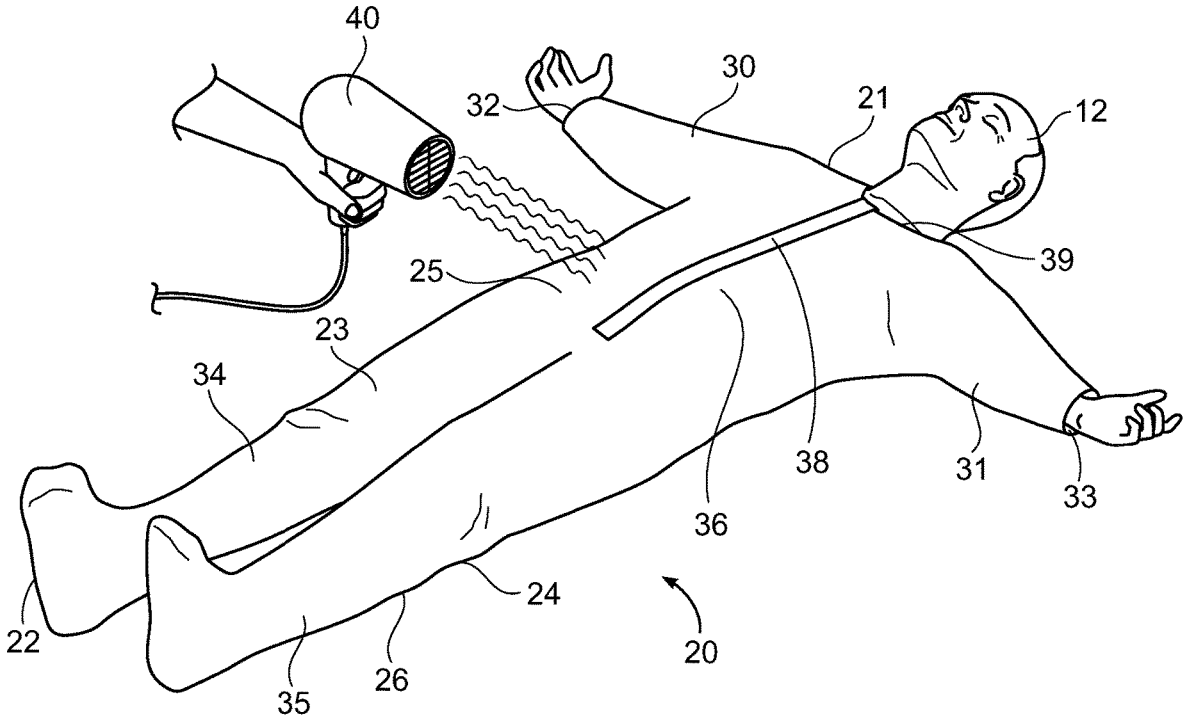
FIG. 6 is an upper perspective view of heat being applied to a body containment garment in accordance with an example embodiment.

The manner in which heat is applied to the containment garment 20 so as to shrink the containment garment 20 around the body 12 may vary in different embodiments. Any type of heat source 40 may be utilized, though it is preferable that the heat source 40 that is handheld such as a hot air blower or the like as shown in the figures. In some embodiments, the entire containment garment 20 and body 12 may be placed in a chamber in which heat is uniformly applied to shrink-fit the containment garment 20 around the body 12. In other embodiments, handheld heat sources 40 may be utilized such as shown in FIG. 6.

C. Operation of Preferred Embodiment.

Figure 10:
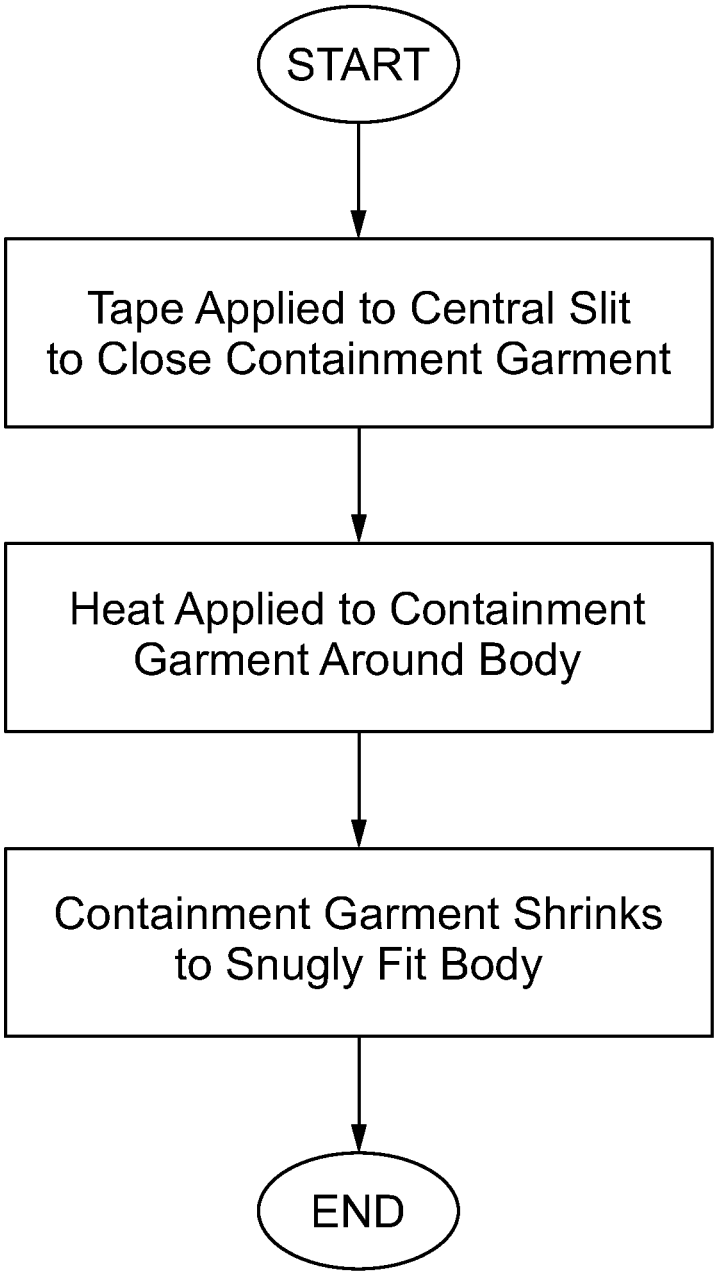
FIG. 10 is a flowchart illustrating the shrink-heating of a body containment garment in accordance with an example embodiment.

In use, the containment garment 20 is first loosely fit around the body 12 of the deceased as described in FIG. 10. The containment garment 20 may laid flat on a surface, such as a table or ground surface, and spread open around the central slit 37. The body 12 may then be laid on top of the containment garment 20, with the body 12 resting on the opened body portion 36 of the containment garment 20.

Figure 5:
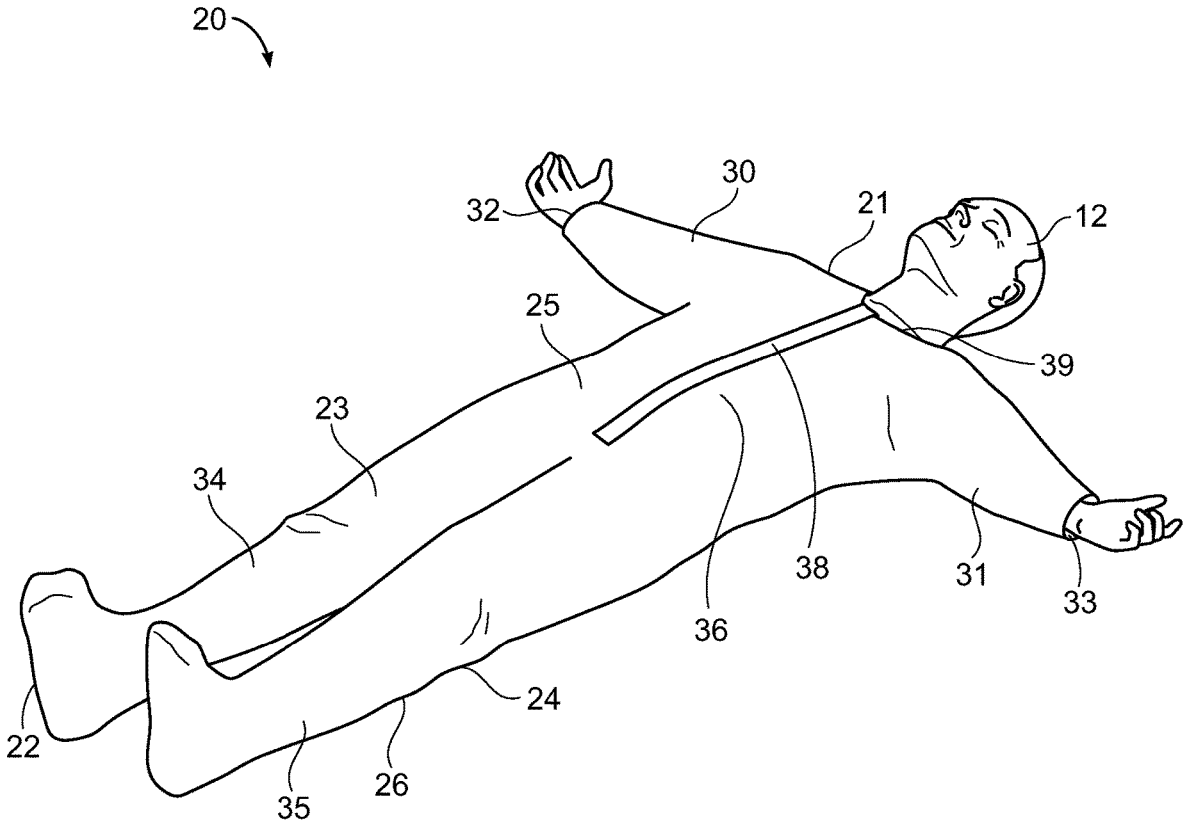
FIG. 5 is an upper perspective view of a loosely worn body containment garment with the central slit closed in accordance with an example embodiment.

The first arm may be positioned in the first arm portion 30, with the first hand extending out of the first arm opening 32. The second arm may similarly be positioned in the second arm portion 31, with the second hand extending out of the second arm opening 33. The first leg may be positioned in the first leg portion 34 and the second leg may be positioned in the second leg portion 35. As the leg portions 34, 35 are enclosed, the feet will generally be covered by the leg portions 34, 35. The body portion 36 may then be closed around the body 12, with the central slit 37 being partially closed such as shown in FIG. 5.

With the body 12 initially positioned within the loose containment garment 20, the central slit 37 on the front end 25 of the body portion 36 of the containment garment 20 may be closed. If necessary, the neck opening 39 may be enlarged by cutting such as with scissors. A closure device, such as heat-shrink tape 38, may be applied to close the central slit 37 and secure the containment garment 20 loosely around the body 12 such as shown in FIG. 6 and illustrated in FIG. 10.

With the containment garment 20 loosely fit around the body 12 and closed by tape 38 covering the central slit 37 of the body portion 36, heat may be applied to the containment garment 20 to shrink the containment garment 20 to fit snugly and tightly around the body 12 and thus prevent leakage of fluids and the like. As discussed previously, heat may be applied uniformly across the entire containment garment 20, including the tape 38, by a heat source 40. In the case of a hand-held heat source 40, an individual may manually move the heat source 40 over the containment garment 20 and tape 38 so as to heat-shrink the tape 38 and containment garment 20 around the body 12 for a tight, secure, and sealed fit.

Figure 7:
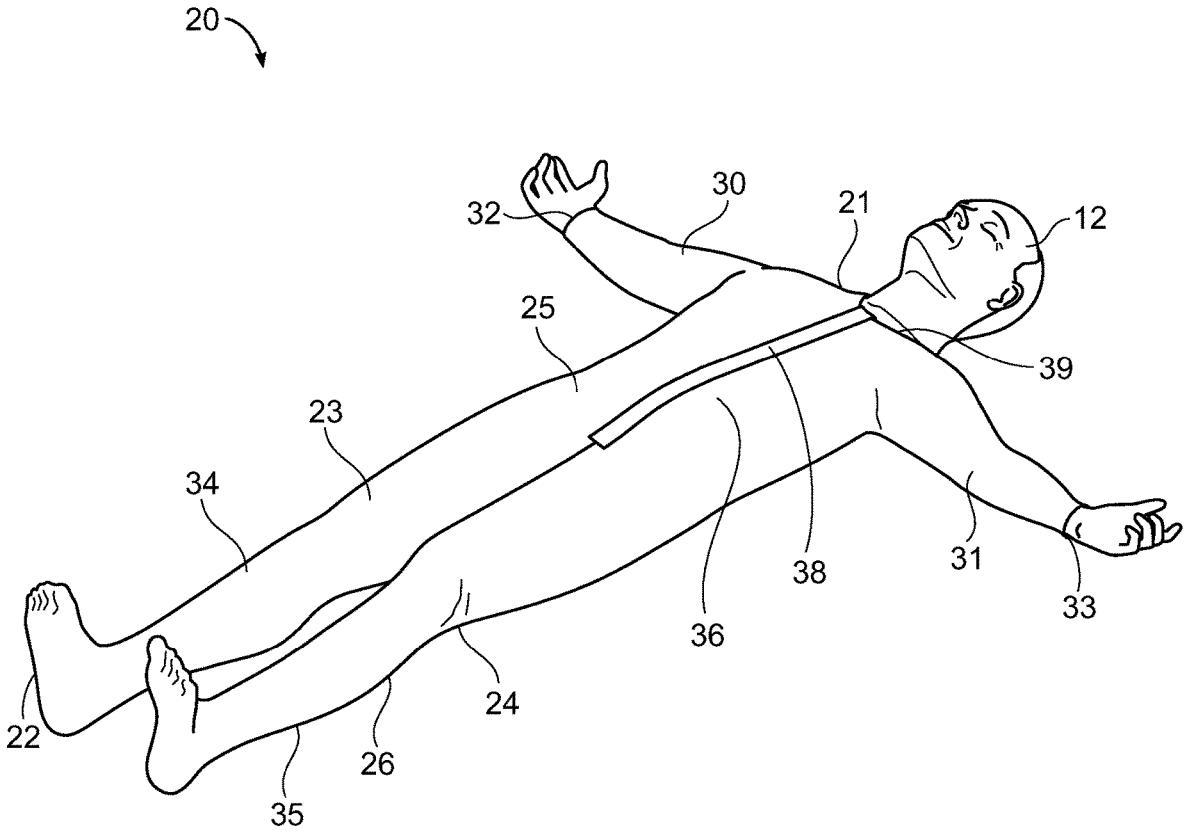
FIG. 7 is an upper perspective view of a heat-shrunk body containment garment in accordance with an example embodiment.
Figure 8:
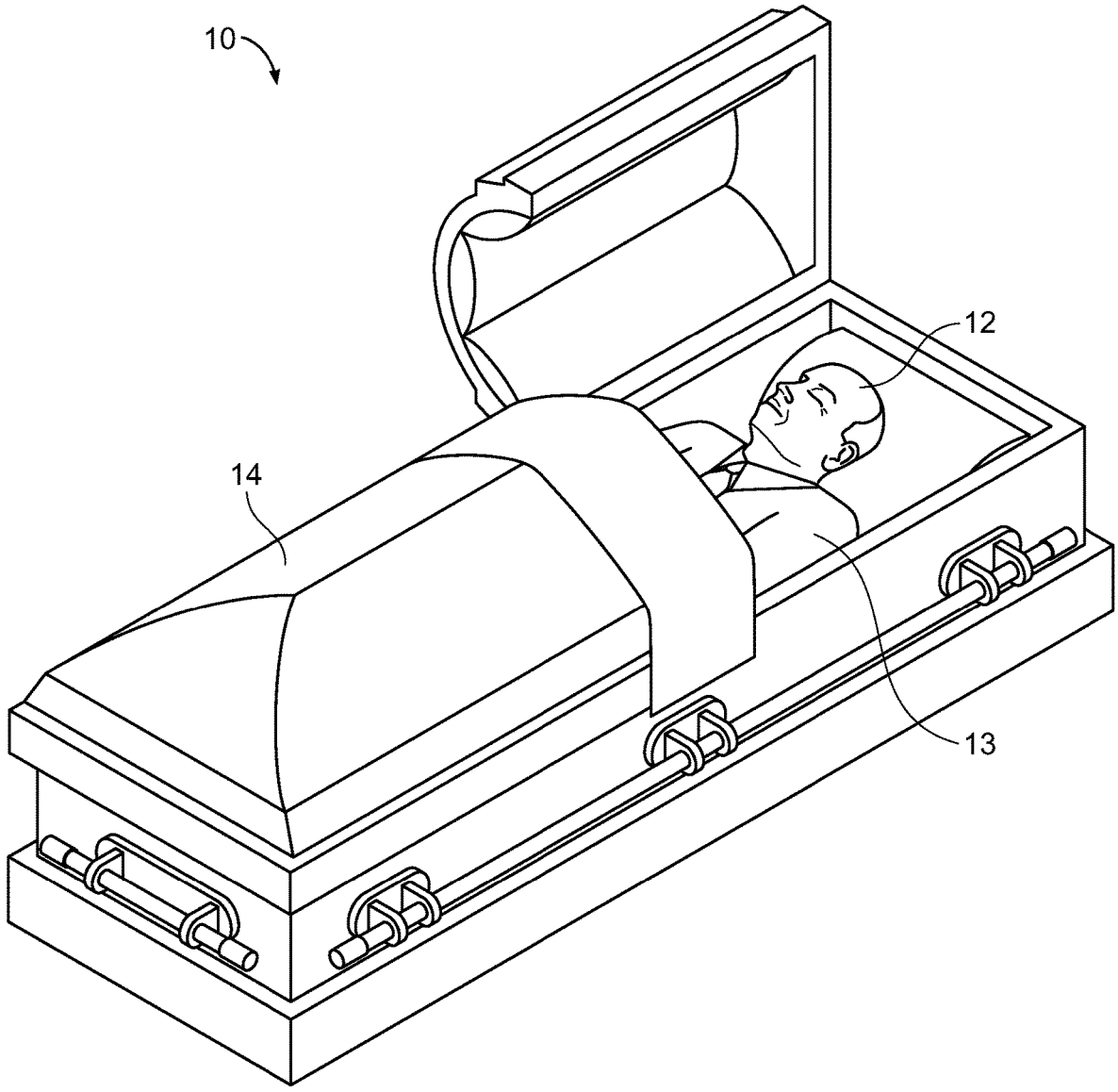
FIG. 8 is an upper perspective view of a body using the body containment garment in a coffin in accordance with an example embodiment.
Figure 9:
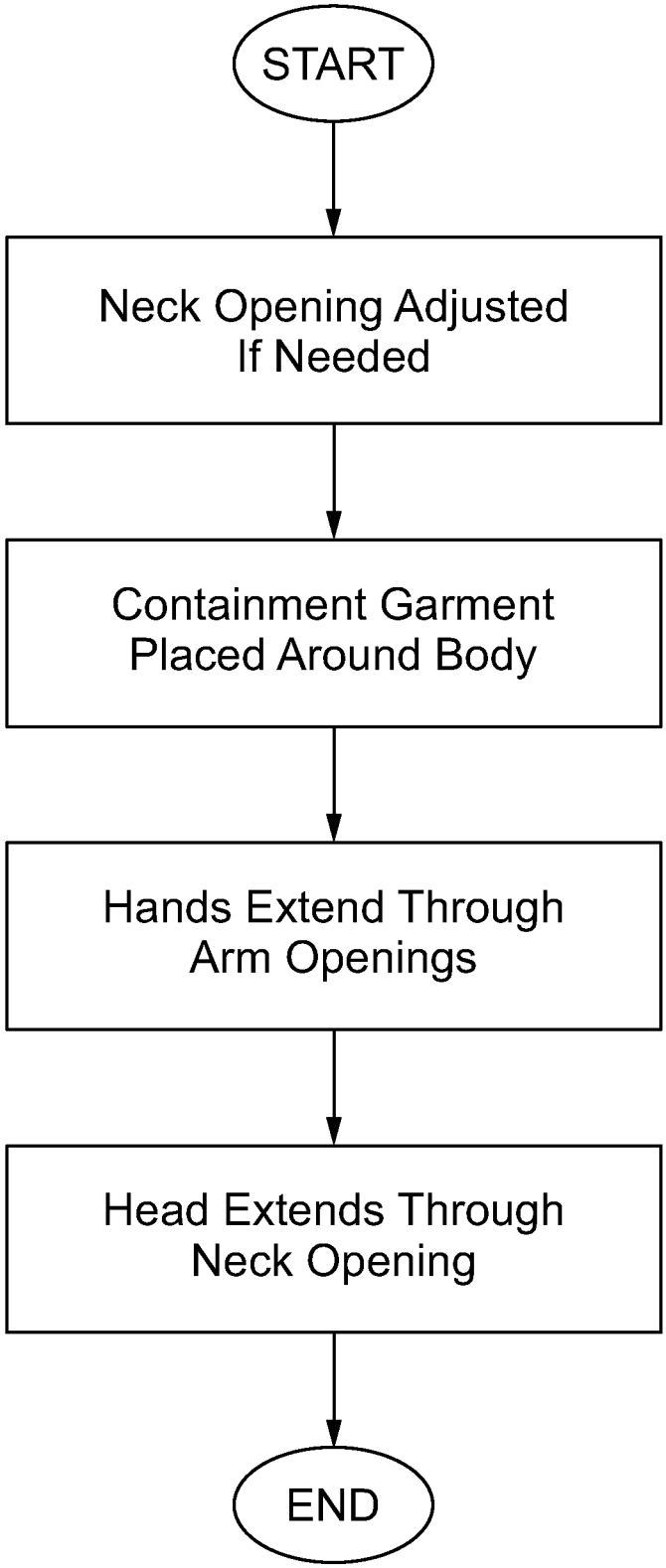
FIG. 9 is a flowchart illustrating positioning a body within a body containment garment in accordance with an example embodiment.

As shown in FIG. 7, the containment garment 20 has been shrunk to snugly and tightly fit the body 12 of the deceased. The only openings in the containment garment 20 are the neck opening 39 and arm openings 32, 33 so as to prevent leakage of fluids and the like. Burial clothing 13 may then be put over the containment garment 20.

Figure 11:
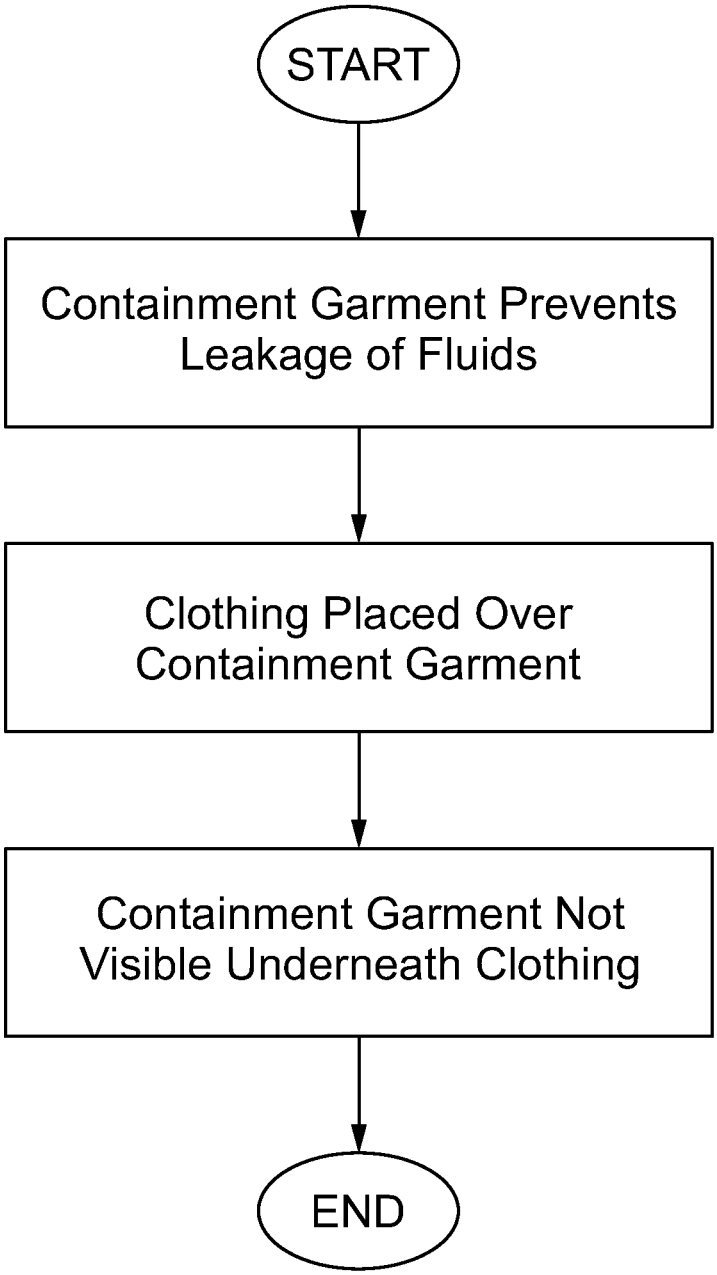
FIG. 11 is a flowchart illustrating use of a body containment garment in accordance with an example embodiment.

As the containment garment 20 is snugly and tightly sealed to the body 12, the containment garment 20 will not be noticeable underneath the burial clothing 13 during any viewing as described in FIG. 11. If a coffin 14 is used, the deceased may be placed into the coffin 14 with burial clothing 13 on. The coffin 14 may be slightly inclined toward the feet of the deceased so that any fluids leak toward the enclosed, sealed leg portions 34, 35 rather than escaping through the neck opening 39 or arm openings 32, 33.

Unless otherwise defined, all technical and scientific terms used herein have the same meaning as commonly understood by one of ordinary skill in the art to which this invention belongs. Although methods and materials similar to or equivalent to those described herein can be used in the practice or testing of the body containment garment, suitable methods and materials are described above. All publications, patent applications, patents, and other references mentioned herein are incorporated by reference in their entirety to the extent allowed by applicable law and regulations. The body containment garment may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A body containment garment for a deceased individual, comprising:

a body portion comprised of an upper end, a lower end, a first side, a second side, a front end, and a rear end, wherein the body portion is adapted to fit around a body of the deceased individual;

a neck opening at or near the upper end of the body portion through which a head of the body of the deceased individual may extend;

a first arm portion extending outwardly from the body portion in a first direction, wherein the first arm portion is adapted to receive a first arm of the deceased individual;

a second arm portion extending outwardly from the body portion in a second direction, wherein the second arm portion is adapted to receive a second arm of the deceased individual;

a first leg portion extending outwardly from the body portion, wherein the first leg portion is adapted to receive a first leg of the deceased individual;

a second leg portion extending outwardly from the body portion, wherein the second leg portion is adapted to receive a second leg of the deceased individual; and a central slit extending between the upper end and the lower end of the body portion;

wherein the body portion, the first arm portion, the second arm portion, the first leg portion, and the second leg portion each comprise a heat-shrinkable material such that the body portion, the first arm portion, the second arm portion, the first leg portion, and the second leg portion shrink to tightly fit around the body of the deceased individual upon application of heat from a heat source.

2. The body containment garment of claim 1, comprising a closure device for closing the central slit around the body of the deceased individual.

3. The body containment garment of claim 2, wherein the closure device is comprised of tape.

4. The body containment garment of claim 3, wherein the tape is comprised of heat-shrinkable tape.

5. The body containment garment of claim 1, wherein the body portion, the first arm portion, the second arm portion, the first leg portion, and the second leg portion are comprised of a unitary structure.

6. The body containment garment of claim 1, wherein the body portion, the first arm portion, the second arm portion, the first leg portion, and the second leg portion are each comprised of a plastic material for the heat-shrinkable material.

7. The body containment garment of claim 1, wherein the body portion, the first arm portion, the second arm portion, the first leg portion, and the second leg portion are each comprised of polypropylene sheeting for the heat-shrinkable material.

8. The body containment garment of claim 1, wherein the body portion, the first arm portion, the second arm portion, the first leg portion, and the second leg portion are each comprised of polyethylene sheeting for the heat-shrinkable material.

9. The body containment garment of claim 1, wherein the heat source is comprised of a handheld air blower.

10. The body containment garment of claim 1, wherein the first arm portion comprises a first arm opening and the second arm portion comprises a second arm opening.

11. The body containment garment of claim 1, wherein the neck opening is adjustable in size.

12. A method of using the body containment garment of claim 1, comprising the steps of:

positioning the body containment garment on a flat surface;

positioning the body of the deceased individual on the body containment garment;

positioning the first arm of the deceased individual in the first arm portion of the body containment garment;

positioning the second arm of the deceased individual in the second arm portion of the body containment garment;

positioning the first leg of the deceased individual in the first leg portion of the body containment garment;

positioning the second leg of the deceased individual in the second leg portion of the body containment garment; and closing the central slit so as to enclose the body of the deceased individual within the body containment garment.

13. The method of claim 12, further comprising the step of applying a closure device to close the central slit of the body containment garment.

14. The method of claim 13, further comprising the step of applying heat to the closure device over the central slit of the body containment garment.

15. The method of claim 13, further comprising the step of applying heat to the body containment garment such that the body containment garment shrinks around the body of the deceased.

16. The method of claim 15, wherein the heat source is comprised of a handheld air blower.

17. The method of claim 12, wherein the body containment garment comprises a polypropylene material for the heat-shrinkable material.

18. A body containment garment, comprising:

a body portion comprised of an upper end, a lower end, a first side, a second side, a front end, and a rear end, wherein the body portion is adapted to fit around a body of a deceased individual;

a neck opening at or near the upper end of the body portion through which a head of the body of the deceased individual may extend;

a first arm portion extending outwardly from the body portion in a first direction, wherein the first arm portion is adapted to receive a first arm of the deceased individual, wherein the first arm portion comprises a first arm opening through which a first hand of the deceased individual may extend;

a second arm portion extending outwardly from the body portion in a second direction, wherein the second arm portion is adapted to receive a second arm of the deceased individual, wherein the second arm portion comprises a second arm opening through which a second hand of the deceased individual may extend;

a first leg portion extending outwardly from the body portion, wherein the first leg portion is adapted to receive a first leg of the deceased individual, wherein a distal end of the first leg portion is enclosed;

a second leg portion extending outwardly from the body portion, wherein the second leg portion is adapted to receive a second leg of the deceased individual, wherein a distal end of the second leg portion is enclosed; and a central slit extending between the upper end and the lower end of the body portion;

wherein the body portion, the first arm portion, the second arm portion, the first leg portion, and the second leg portion each comprise a heat-shrinkable material such that the body portion, the first arm portion, the second arm portion, the first leg portion, and the second leg portion shrink to tightly fit around the body of the deceased individual upon application of heat from a heat source.

19. The body containment garment of claim 18, wherein the body portion, the first arm portion, the second arm portion, the first leg portion, and the second leg portion are each comprised of polypropylene sheeting for the heat-shrinkable material.

20. The body containment garment of claim 19, wherein the polypropylene sheeting comprises a thickness of 6 millimeters.

* * * * *